US005333860A

United States Patent [19]

Saito et al.

[11] Patent Number: 5,333,860

[45] Date of Patent: Aug. 2, 1994

[54] GOLF CLUB SETS

[75] Inventors: Shinkichi Saito; Hideyo Asabuki, both of Tokyo; Atsushi Onozato, Hiratsuka; Toshinori Nishimura, Hiratsuka; Kazuo Kawada, Hiratsuka; Shinji Yamamoto, Hiratsuka, all of Japan

[73] Assignee: The Yokohama Rubber Co., Ltd., Tokyo, Japan

[21] Appl. No.: 118,772

[22] Filed: Sep. 10, 1993

Related U.S. Application Data

[63] Continuation of Ser. No. 996,641, Dec. 24, 1992, abandoned.

[30] Foreign Application Priority Data

Dec. 27, 1991 [JP] Japan ..... 3-346414
Dec. 27, 1991 [JP] Japan ..... 3-346425
Dec. 27, 1991 [JP] Japan ..... 3-346434

[51] Int. Cl.[5] ..... A63B 53/00

[52] U.S. Cl. ..... 273/77 A; 273/80 C; 273/167 G

[58] Field of Search ..... 273/77 R, 77 A, 167 G, 273/167 R, 80 A, 80 C, 77 A

[56] References Cited

U.S. PATENT DOCUMENTS

| | | | |
|---|---|---|---|
| 3,266,805 | 8/1966 | Bulla | 273/77 A |
| 3,655,188 | 4/1972 | Solheim | 273/77 A |
| 4,762,322 | 8/1988 | Molitor et al. | 273/77 A |
| 4,802,672 | 2/1989 | Long | 273/77 A |
| 4,895,367 | 1/1990 | Kajita | 273/77 A |
| 4,941,666 | 7/1990 | Suganuma | 273/77 AX |
| 5,209,474 | 5/1993 | Voyer | 273/167 GX |

FOREIGN PATENT DOCUMENTS

| | | | |
|---|---|---|---|
| 0049130 | 4/1977 | Japan | 273/167 G |
| 2126906 | 4/1984 | United Kingdom | 273/167 G |
| 2233909 | 1/1991 | United Kingdom | 273/167 G |
| 2250924 | 6/1992 | United Kingdom | 273/77 A |

*Primary Examiner*—William E. Stoll
*Attorney, Agent, or Firm*—Finnegan, Henderson, Farabow, Garrett

[57] ABSTRACT

A golf club set consisting of a plurality of golf clubs having a series of continuous club numbers, characterized in that an angle of centroid defined as an angle described between an extension line of a face of a club head and a perpendicular passing through a center axis of a club shaft when the club shaft of each of the golf clubs is placed on a horizontal table with the club head thereof being suspended freely, is smaller for the golf clubs having higher club numbers and progressively larger in the order of decreasing club numbers among a plurality of the golf clubs.

16 Claims, 5 Drawing Sheets

GOLF CLUB SETS

This application is a continuation of application Ser. No. 07/996,641 filed Dec. 24, 1992, now abandoned.

BACKGROUND OF THE INVENTION

This invention relates to golf club sets. More in particular, it relates to golf club sets in which any golf club has a substantially equal level of hitting easiness irrespective of its club number, and which can make equal in directivity of a hit ball golf clubs having lower club numbers which are difficult to handle particularly for amateur golf players, to golf clubs having higher club numbers.

Generally, a golf club set comprises the combination of a series of golf clubs ranging from the club numbers of 1 to 5 in the case of a wood type golf club set and the combination of a series of golf clubs ranging from the club numbers 1 to 9, PW (pitching wedge) and 5 W (sand wedge) in the case of an iron type golf club set. The lower the golf club number, the longer becomes a club shaft and the smaller a loft angle of the face of the club head. Therefore, the lower the golf club number, the more difficult becomes the golf club for an amateur golf player to handle, so that a miss shot is likely to occur and a ball is likely to slice to the right at the time of hitting. Accordingly, the amateur golf players in general seldom use the golf clubs having lower club numbers, and these clubs are mostly kept stored in a golf bag as decorative items.

SUMMARY OF THE INVENTION

It is an object of the present invention to provide golf club sets which enable particularly amateur golf players, who mostly fail to swing at a high head speed, to obtain substantially equal directivity of a ball hit by any golf club irrespective of a club number.

It is another object of the present invention to provide golf club sets which allow a player to swing golf clubs having lower club numbers with the same ease as with golf clubs having higher club numbers.

To accomplish the objects described above, the golf club set according to the present invention employs the structure wherein an angle of centroid $\theta$ defined as an angle described between an extension line of a face of a club head and a line perpendicularly passing through a center axis of a club shaft when the club shaft of each of the golf clubs is placed on a horizontal table with the club head thereof being suspended freely, is so changed as to increase progressively in the order of decreasing club numbers, or is set to a substantially equal one for all the golf clubs.

As described above, the angle of centroid $\theta$ of the golf club having each club number is set so that the club shaft of the golf club having a greater club shaft length and lower club number is brought closer to the centroid of the club head. Therefore, a golf player can catch correctly a ball even with a club having a lower club number in the same way as with a golf club having a small club shaft length and a higher club number. This also holds true of the golf club set in which the angle of centroid $\theta$ of each golf club is set to a substantially equal one for all the golf clubs.

DETAILED DESCRIPTION OF THE PREFERRED EMBODIMENTS

Golf clubs having lower club numbers have a greater club shaft length and are therefore difficult to handle. As a result of intensive studies on the search for means for making these golf clubs having lower club numbers easily handleable or operable in the same way as the golf clubs having higher club numbers and smaller club shaft length, the inventors of the present invention have found out that this handleability is closely associated with an angle of centroid, and that in the golf clubs having greater club shaft length and lower club numbers, the centroid of the club head can be brought closer to a connecting portion of the club shaft as its angle of centroid is increased and in this way, a golf player can more correctly hit a ball.

Figure 6A:
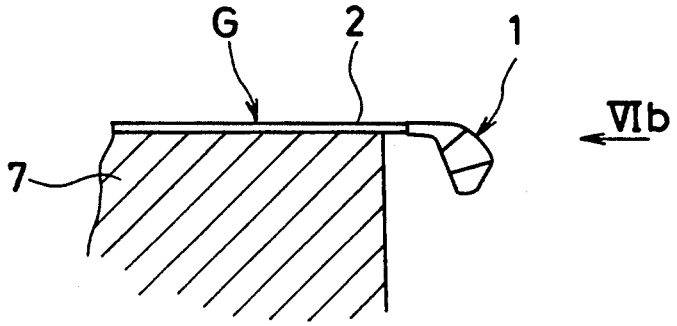
FIG. 6*a* is an explanatory view showing a method of measuring the angle of centroid of a golf club.
Figure 6B:
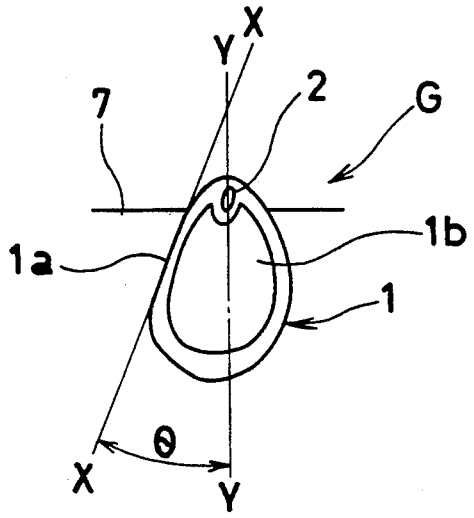
FIG. 6*b* is a view when viewed from a direction of arrow VI*b* of FIG. 6*a;*
Figure 7:
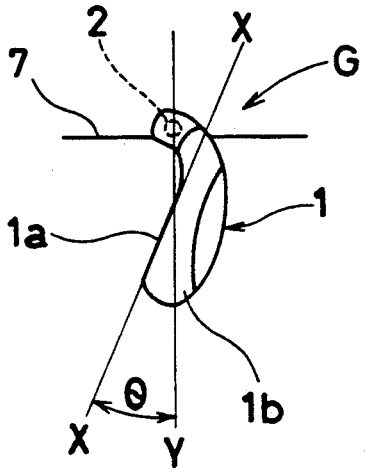
FIG. 7 is an explanatory view showing a method of measuring the angle of centroid of an iron type golf club and corresponding to FIG. 6*b.

In the present invention, the term "angle of centroid" means the angle measured as shown in FIGS. 6*a* and 6*b*. In other words, a club shaft 2 of a golf club G is placed on a horizontal table 7 with its club head 1 being suspended freely outside the horizontal table 7. Then, the club head 1 comes to a halt with its centroid lying on a vertical plane Y—Y containing the center axis of the club shaft 2. An angle $\theta$ between a toe-heel line X—X at the bottom of a striking face 1*a* of the club head 1 and the vertical plane Y—Y passing through the center axis of the club shaft 2 under this state is defined as the "angle of centroid" as shown in FIG. 6*b*. Though FIGS. 6*a* and 6*b* show the case of a wood type golf club, the angle of centroid $\theta$ of an iron type golf club can be measured similarly as shown in FIG. 7.

Figure 8:
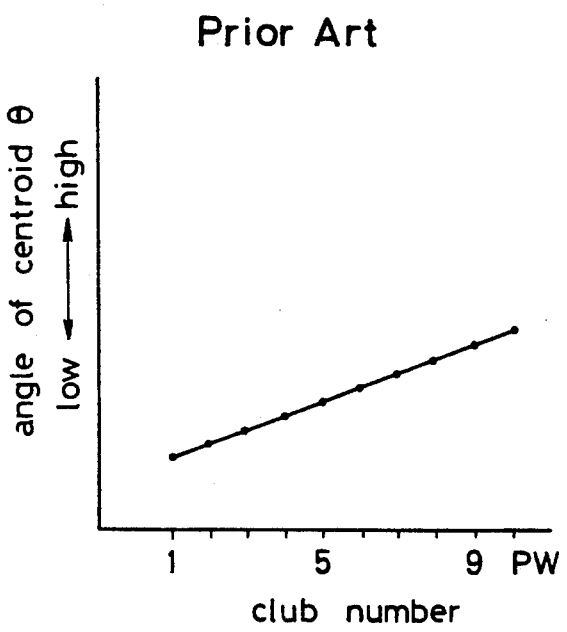
* and FIG. 8 is an explanatory graph showing the relation between club numbers and angles of centroid of a golf club set according to a pair art.

When the angles of centroid $\theta$ are examined for golf clubs constituting conventional golf club sets, the angles of centroid are smaller for golf clubs having lower club numbers, and are greater for golf clubs having higher club numbers as shown in FIG. 8. Table below represents a definite example of the relation between the club numbers and the angles of centroid in the conventional golf club set.

| Club No. | #1 | #2 | #3 | #4 | #5 | #6 | #7 | #8 | #9 | PW |
|---|---|---|---|---|---|---|---|---|---|---|
| Angle of centroid $\theta$ | 4° | 6° | 8° | 10° | 12° | 14° | 16° | 18° | 20° | 22° |

In other words, in the conventional golf club set, the connecting position of the club shaft to the club head is much more spaced from the centroid of the club head with a golf club of a lower club number. Since the distance between the club shaft and the centroid of the club head is great and the club shaft length is great as described above, such a golf club is particularly difficult to handle for an amateur golf player who can produce only a low head speed.

Figure 3:
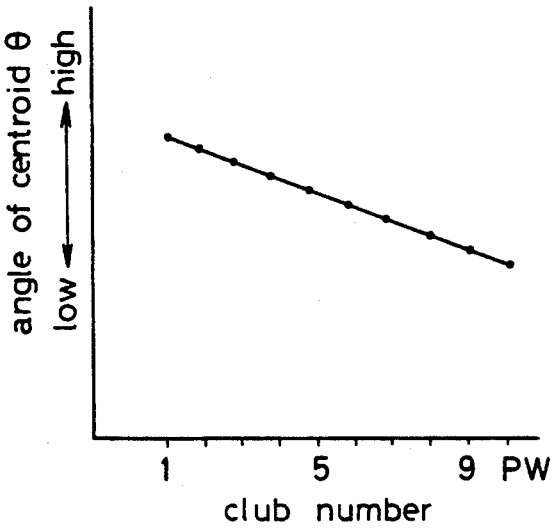
FIG. 3 is an explanatory graph showing the relation between club numbers and angles of centroid of a gold club set according to an embodiment of the present invention.

In the golf club sets according to the present invention, the club numbers of a plurality of golf clubs constituting the golf club set have the relation with the angles of centroid $\theta$ as shown in FIG. 3. For example, the angle of centroid is greater in the golf club #1 having a low club number and is smaller with PW (#10) having a high club number. In other words, the connecting position of the club shaft to the club head is closer to the centroid of the club head in the golf club having a greater club shaft length and a lower club number, and according to this arrangement, even an amateur golf player whose fails to get a high head speed can handle easily the golf clubs having lower club numbers in the same way as the golf clubs having higher club numbers. In the present invention, the angle of centroid of PW having a higher club number is preferably set to about 22° and the angle of centroid may be incremented by 1° to 3° as the club number is decremented by one. Needless to say, the angles of centroid may be changed in accordance with the desire of the golf player.

In the golf club set having the construction shown in FIG. 3, the difference of the angles of centroid between the golf clubs having the adjacent club numbers is preferably the same. If the difference of the angles of centroid $\theta$ between the golf clubs having adjacent club numbers is the same across all the golf clubs constituting the golf club set, feeling at the time of hitting a ball can be changed continuously between the golf clubs, and the golf club set becomes easier for the player to swing and hit the ball.

Figure 4:
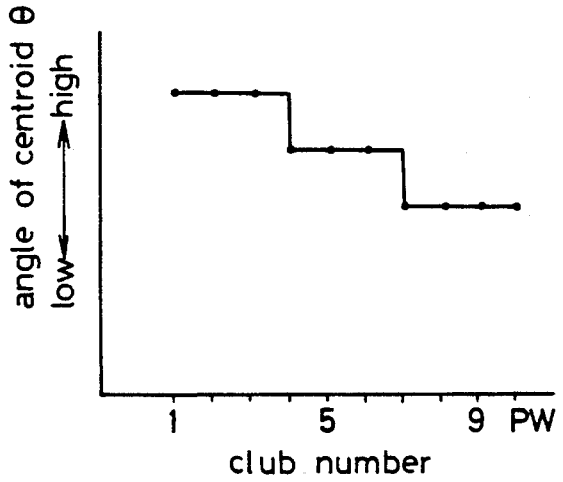
FIG. 4 is an explanatory graph showing the relation between club numbers and angles of centroid of a golf club set according to another embodiment of the invention.
Figure 5:
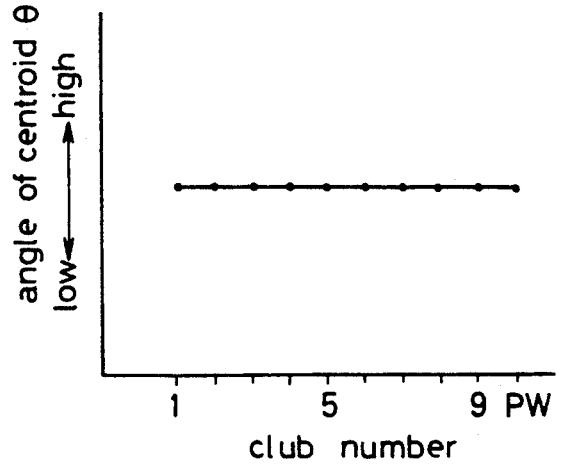
FIG. 5 is an explanatory graph showing the relation between club numbers and angles of centroid of a golf club set according to still another embodiment of the invention.

The present invention employs the structure in which the angles of centroid are increased for the golf clubs having lower club numbers and are decreased for the golf clubs having higher club numbers. In comparison with the continuous change of the angles of centroid as shown in FIG. 3, the angles of centroid may be changed step-wise as shown in FIG. 4 and the angles of centroid of all the golf clubs constituting the golf club set may be set to an equal one as shown in FIG. 5. In either case, substantially the same effect can be obtained.

The angles of centroid can be changed stepwise in the following way as shown in FIG. 4. For example, a group of long iron type golf clubs of the club numbers #1 to #3 are provided with the same angle of centroid, a group of middle iron type golf clubs of the club numbers #4 to #6 are provided by the same angle of centroid which is smaller than that of the long iron type golf clubs, and finally, a group of golf clubs having the club numbers #7 to #10 (PW) are provided with the same angle of centroid, which is smaller than that of the middle iron type golf clubs.

Figure 1A:
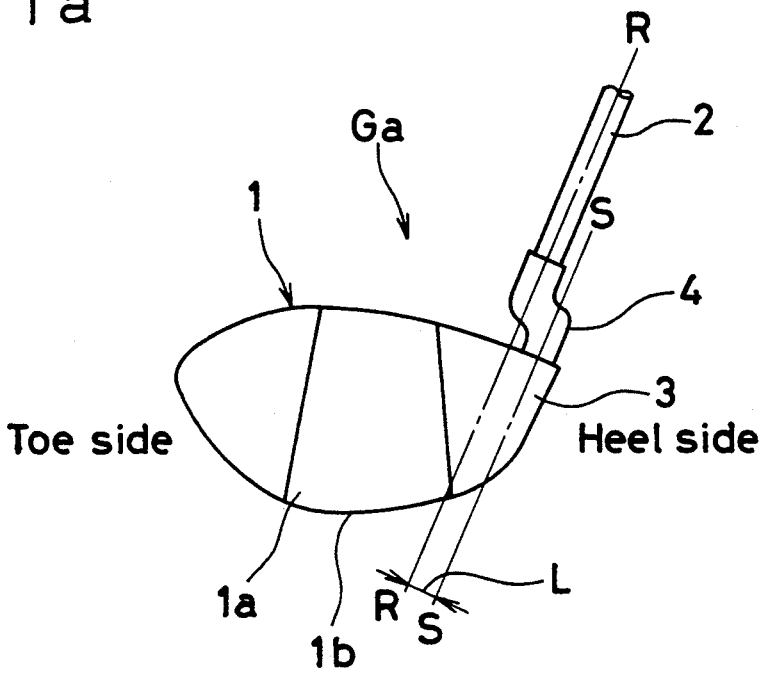
FIGS. 1*a* and 1*b* are respectively a front view and a side view of a wood type golf club constituting a golf club set according to the present invention.
Figure 1B:
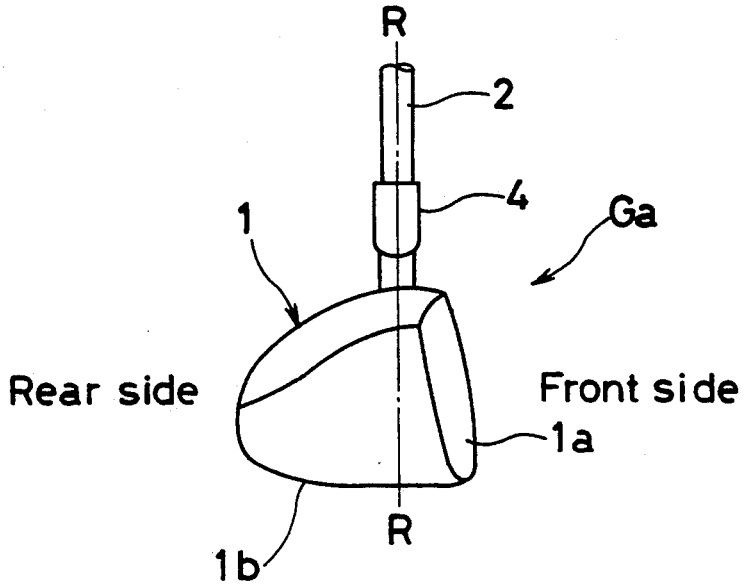
Figure 2A:
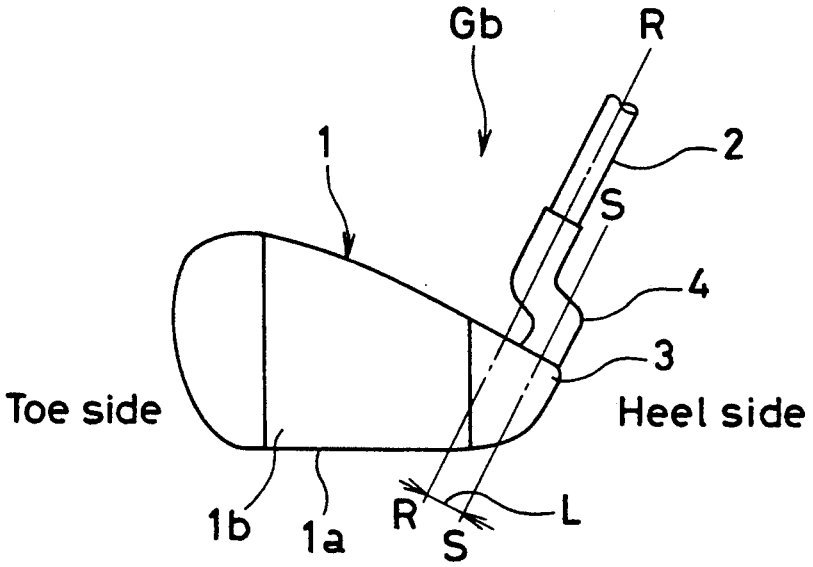
FIGS. 2*a* and 2*b* are respectively a front view and a side view of an iron type golf club constituting a golf club set according to the present invention.
Figure 2B:
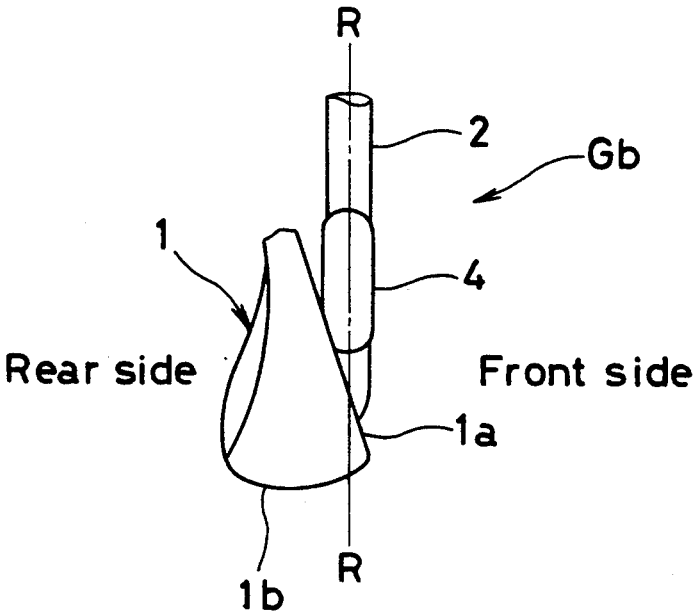

As the golf clubs constituting the golf club sets described above, wood type golf clubs preferably have the structure such as shown in FIGS. 1*a* and 1*b* and iron type golf clubs preferably have the structure shown in FIGS. 2*a* and 2*b*.

In the wood type golf club Ga shown in FIG. 1*a*, 1*b* and the iron type golf club Gb shown in FIGS. 2*a*, 2*b*, a hosel 4 bent in a crank shape is fixed to a neck 3 on the heel side of the club head 1, and the club shaft 2 is connected and fixed through this hosel 4. The crank shape of the hosel 4 is offset in a direction extending from the neck 3 to the face 1*a* towards the toe side. In other words, the center axis R—R of the hosel on the side of the club shaft 2 is offset inward by a distance L relative to the center axis S—S of the hosel on the side of the neck 3 of the club head 1. The angle of centroid $\theta$ can be adjusted easily by adjusting the offset distance L between the center axis S—S of the hosel on the club head side and the center axis R—R of the hosel on the club shaft side.

The angle of centroid $\theta$ can be increased by increasing the offset distance L and bringing the center axis R—R of the hosel on the side of the club shaft 2 closer to the centroid of the club head 1. However, the fitting position of the club shaft 2 is stipulated to be within 16 mm from the heel by the regulation. Therefore, this offset distance L must be changed within the distance of 16 mm from the heel side.

The golf club set according to the present invention that has the construction described above may comprise the iron type golf clubs alone, or the wood type golf clubs alone, or the combination of the iron type golf clubs and the wood type golf clubs.

The iron type golf club set may comprise the combination of non-metallic golf club made of a resin with the exception of a sole plate and metallic golf clubs. In the case of a golf club set comprising the combination of a plurality of wood type golf clubs and iron type golf clubs, the angles of centroid $\theta$ are changed in such a way that a group of the iron type golf clubs follow a group of the wood type golf clubs: For instance, if the group of the wood type has club numbers 1 to 4 and the group of the iron type has club numbers 3 to 9, the angles of centroid $\theta$ decrease like this; the club number 1 to 4 of the wood type and the club number 3 to 9 of the iron type.

As described above, in the golf club set according to the present invention, an angle of centroid $\theta$ of a golf club is so changed as to increase progressively in the order of decreasing club numbers. Therefore, the club shaft of the golf club having a greater club shaft length and a lower club number is brought closer to the centroid of the club head. Accordingly, even an amateur golf player who cannot produce a high head speed can hit easily and correctly the ball with the golf club having a lower club number. For this reason, the golf player can swing and hit the ball with a substantially equal ease for all the golf clubs from the golf clubs having lower club numbers to the golf clubs having higher club numbers.

What is claimed is:

1. A golf club set comprising a plurality of golf clubs having a series of individual club numbers, characterized in that an angle of centroid, defined as an angle subtended by a toe-heel line at the bottom of a striking face of a club head and a vertical plane containing a center axis of a club shaft attached to the club head when the club shaft is supported horizontally with the club head thereof being suspended freely, increases in the order of decreasing club numbers among the plurality of said golf clubs.

2. A golf club set according to claim 1, wherein the increment of difference in the angle of centroid between said golf clubs having consecutive club numbers is constant throughout said plurality of said golf clubs.

3. A golf club set according to claim 1, wherein at least some of consecutively numbered golf clubs in the golf club set each include a crank-shaped hosel for connecting the club head and club shaft thereof so that a connection of said hosel to said club shaft and a connection of said hosel to said club head are offset in the direction of said toe-heel line by an offset distance L between a center axis of said connection to said club head and a center axis of said connection to said club shaft, the offset distance L being progressively greater in the order of decreasing club numbers among said at least some of said golf clubs.

4. A golf club set according to claim 3, wherein said offset distance is 16 mm maximum.

5. A golf club set according to claim 1, wherein a group of the plurality of said golf clubs comprises iron type golf clubs.

6. A golf club set according to claim 5, wherein said iron type golf clubs comprise a sub-group of non-metallic clubs having lower club numbers and a sub-group of metallic clubs having higher club numbers.

7. A golf club set according to claim 1, wherein a group of the plurality of said golf clubs comprises wood type golf clubs.

8. A golf club set according to claim 1, wherein the plurality of said golf clubs comprises a combination of wood type golf clubs and iron type golf clubs.

9. A golf club set comprising a plurality of golf clubs having a series of individual club numbers, characterized in that an angle of centroid defined as an angle subtended by a toe-heel line at the bottom of a striking face of a club head and a vertical plane containing a center axis of a club shaft attached to the club head when the club shaft is supported horizontally with the club head thereof being suspended freely, is the same for all of the plurality of said golf clubs.

10. A golf club set according to claim 9, wherein the golf clubs each include a crank-shaped hosel for connecting the club head and club shaft thereof so that a connection of said hosel to said club shaft and a connection of said hosel to said club head are offset in the direction of said toe-heel line by an offset distance L between a center axis of said connection to said club head and a center axis of said connection to said club shaft, the offset distance being progressively greater in the order of decreasing club numbers among at least some of said plurality of golf clubs.

11. A golf club set according to claim 10, wherein said offset distance L is 16 mm maximum.

12. A golf club set according to claim 9, wherein a group of the plurality of said golf clubs comprises iron type golf clubs.

13. A golf club set according to claim 12, wherein said iron type golf clubs comprise a sub-group of non metallic clubs having lower club numbers and a sub-group of metallic clubs having higher club numbers.

14. A golf club set according to claim 9, wherein a group of the plurality of said golf clubs comprises wood type golf clubs.

15. A golf club set according to claim 9, wherein the plurality of said golf clubs comprises a combination of wood type golf clubs and iron type golf clubs.

16. A golf club set comprising a plurality of golf clubs having a series of individual club numbers, the plurality of golf clubs including club groups, each such club group having golf clubs with consecutive club numbers, characterized in that an angle of centroid, defined as an angle subtended by a toe-heel line at the bottom of a striking face of a club head and a vertical plane containing a center axis of a club shaft attached to the club head when the club shaft is supported horizontally with the club head thereof being suspended freely, is the same for the golf clubs in each of said club groups, said angles of centroid for the club groups increasing in the order of decreasing club numbers in the plurality of golf clubs.

* * * * *